United States Patent [19]

Walker et al.

[11] Patent Number: 5,070,943

[45] Date of Patent: Dec. 10, 1991

[54] APPARATUS AND METHOD FOR PERFORATING A WELL

[75] Inventors: Jerry L. Walker, Ft. Worth; Bennie Gill, Burleson; Jerry D. Motley, Arlington, all of Tex.

[73] Assignee: Jet Research Center, Inc., Alvarado, Tex.

[21] Appl. No.: 633,831

[22] Filed: Dec. 26, 1990

[51] Int. Cl.[5] ..... E21B 21/00; E21B 43/117; E21B 43/118

[52] U.S. Cl. ..... 166/297; 166/312; 166/55.1; 166/50; 166/384; 175/4.6

[58] Field of Search ..... 175/4.52, 4.55, 4.6, 175/2; 166/298, 297, 299, 55, 55.1, 312, 50, 384

[56] References Cited

U.S. PATENT DOCUMENTS

| | | | |
|---|---|---|---|
| 2,340,966 | 2/1944 | Kitsman | 175/4.55 |
| 3,174,547 | 3/1965 | Fields | 175/4.6 X |
| 3,348,621 | 10/1967 | Schuster | 175/4.6 X |
| 3,357,504 | 12/1967 | Calhoun | 175/4.6 X |
| 3,856,094 | 12/1974 | Davis | 175/4.52 |
| 4,760,883 | 8/1988 | Dunn | 166/297 |

*Primary Examiner*—Stephen J. Novosad

*Attorney, Agent, or Firm*—E. Harry Gilbert, III; Robert A. Kent

[57] ABSTRACT

A perforating gun and method permit a casing or liner within a well to be perforated even within a section obstructed by sand either before or after perforation. The perforating gun comprises a support for carrying a plurality of explosive charges and one or more channels for conducting a fluid through the support, which channels are spaced from where the plurality of explosive charges are carried on the support. A method of perforating a well comprises: lowering a perforating gun into the well; flowing fluid through the perforating gun before or after the perforating gun is detonated; and detonating the perforating gun.

8 Claims, 5 Drawing Sheets

APPARATUS AND METHOD FOR PERFORATING A WELL

BACKGROUND OF THE INVENTION

This invention relates generally to apparatus and methods for perforating a well. The invention relates more particularly, but not by way of limitation, to a perforating gun and method suitable for use in, for example, a sand-containing slotted liner located in a non-vertical section of an oil or gas well.

An oil or gas well typically has a lining made of metallic casing or liners cemented in the earthen well bore. If such a lining traverses a hydrocarbon-bearing formation, the lining is perforated to create holes through the metal and cement so that the hydrocarbons can flow from the formation into the well. Perforating conventionally includes lowering an explosive charge-carrying perforating gun into the well and then detonating the explosive charges to blast openings into the lining and wall of the well bore.

Such conventional perforating is suitable for perforating within vertical sections of a well. Conventional perforating may also be useful in non-vertical sections of directionally drilled wells. In either vertical or non-vertical uses, however, conventional perforating can encounter problems from sand entering the well, for example. Such problems can be most apparent when considering a horizontal section of a well as will be done in the following illustrative explanation.

Because gravity does not pull material through a horizontal section as it does through a vertical section of a well, a horizontal section can more readily fill with sand ("sand" as used herein encompasses particulate earthen material and drilling and other debris which can flow or move into a well). This is particularly a problem in a horizontal section of a well lined with a liner which already is slotted with openings to allow hydrocarbon flow, but which openings also allow sand to flow into the interior of the liner. Although a slotted liner allows hydrocarbon flow, it or some other section of the well might still need to be perforated. If such a horizontal section fills with sand before the well can be perforated, the sand can prevent a perforating gun from being located at a desired location. If such a horizontal section fills with sand upon perforating the well, the detonated perforating gun might not be easily retrieved. This latter problem could also occur if the well bore collapses within the horizontal section upon detonation of the perforating gun.

To overcome these problems of being unable to emplace or retrieve a perforating gun, there is the need for an apparatus and method which will allow a perforating gun to be placed at any desired location within a well, even a sand-obstructed section, and to be retrieved once the gun has been detonated.

SUMMARY OF THE INVENTION

The present invention overcomes the above-noted and other shortcomings of the prior art by providing a novel and improved apparatus and method for perforating a well. The present invention allows for perforating even where there is a sand obstruction before or after perforating. The present invention allows fluid to be circulated through the end of the perforating string either before or after, or both before and after, the well is perforated to flush sand so that a perforating gun can be emplaced and removed.

The apparatus of the present invention includes a perforating gun, comprising: support means for carrying a plurality of explosive charges; and channel means for conducting a fluid through the support means, which channel means is spaced from where the plurality of explosive charges are carried on the support means.

In accordance with one definition, the present invention provides a method of perforating a well, comprising: lowering a perforating gun into the well; flowing fluid through the perforating gun before the perforating gun is detonated; and detonating the perforating gun.

In accordance with another definition, the present invention provides a method of perforating a well, comprising: lowering a perforating gun into the well; detonating the perforating gun; and flowing fluid through the perforating gun after the perforating gun is detonated.

Therefore, from the foregoing, it is a general object of the present invention to provide a novel and improved apparatus and method for perforating a well. Other and further objects, features and advantages of the present invention will be readily apparent to those skilled in the art when the following description of the preferred embodiment is read in conjunction with the accompanying drawings.

DETAILED DESCRIPTION OF PREFERRED EMBODIMENT

Figures 1, 2, 3:
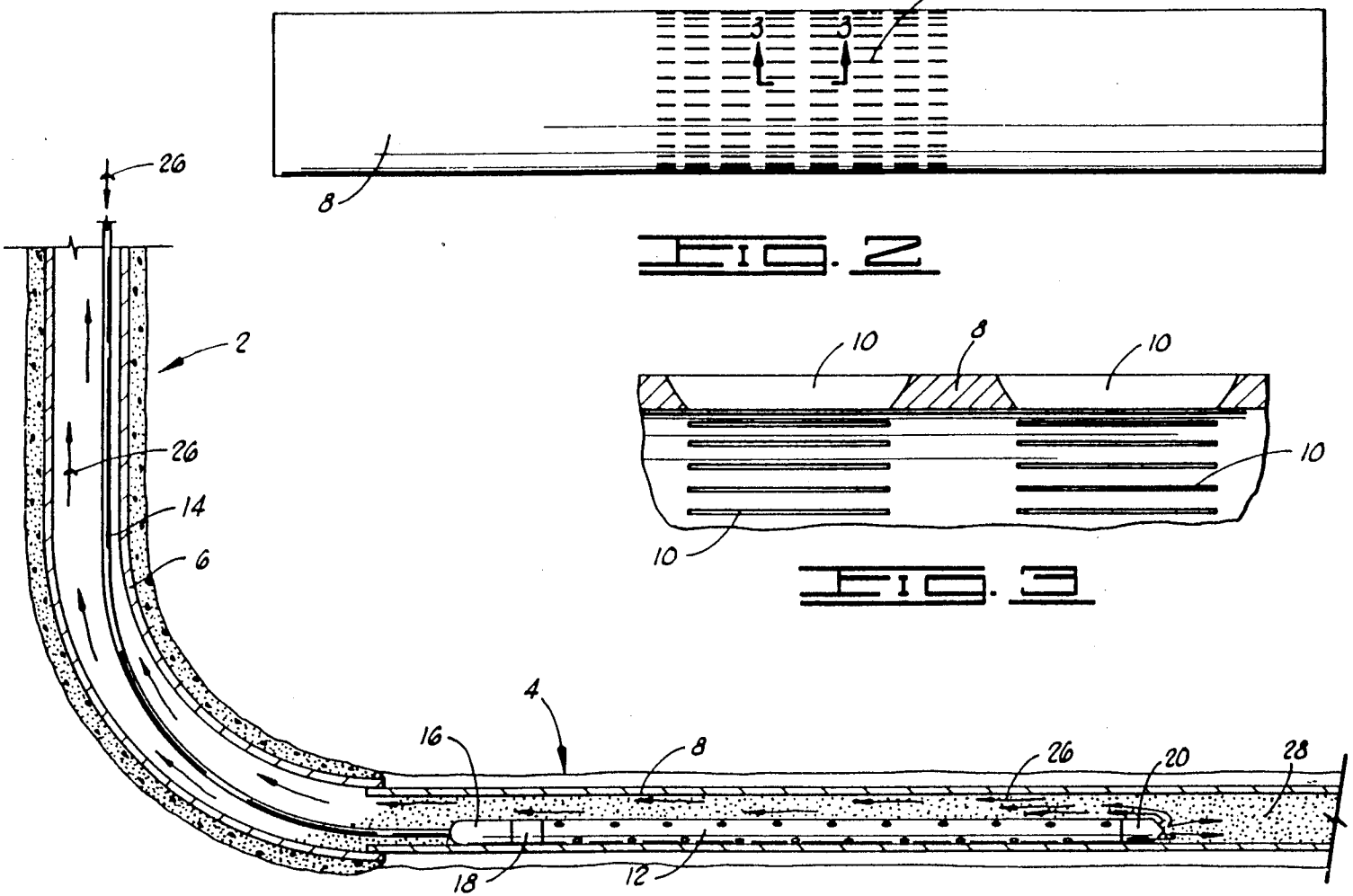
FIG. 1 is a schematic illustration of a perforating gun of the present invention located within a slotted liner lining a horizontal section of a well.
FIG. 2 is an elevational view of the slotted liner.
FIG. 3 is a sectional view of part of the liner showing slots of the slotted liner, as taken along line 3—3 shown in FIG. 2.

A portion of a deviated well bore is shown in FIG. 1. The illustrated portion includes a vertical section 2 and non-vertical sections including a horizontal section 4. The sections are lined with a casing 6 and a slotted liner 8 which may or may not be cemented into the well bore in a known manner. The casing 6 and the slotted liner 8 are known types. A suitable type of slotted liner 8 is illustrated in FIG. 2. The illustrated liner 8 is cylindrical with circumferentially and longitudinally spaced slots 10. A detail of the slots 10 is shown in FIG. 3.

Referring to FIG. 1, a perforating gun 12 constructed in accordance with the present invention is lowered into the well on a known type of equipment, such as on a tubing string 14. In the preferred embodiment, the tubing string 14 is a coil tubing having a firing line inside. Other types of conveyor devices and detonating systems (e.g., a pressure type initiating system) can be used.

The perforating gun 12 is connected to the tubing string 14 by a firing head 16 and a top sub connector 18. At the bottom of the perforating gun 12 (i.e., at the right-hand end as viewed in FIG. 1), there is connected a bull plug and washing shoe assembly 20. The firing head 16 and the assembly 20 are of known types. The top sub 18 will be further described hereinbelow.

Figure 15:
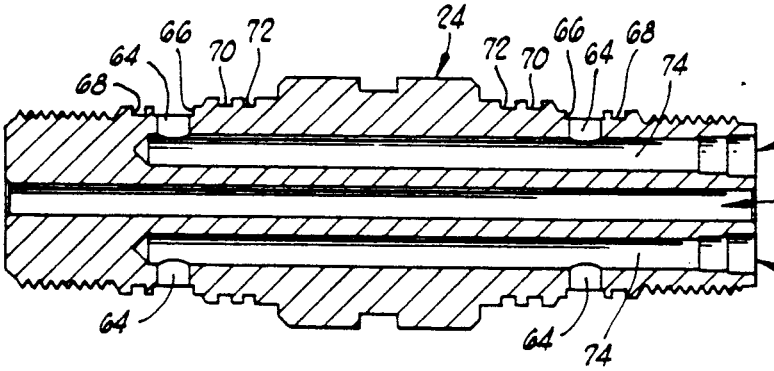
FIG. 15 is a sectional elevational view, taken along line 15—15 in FIG. 16, of a tandem connector.
Figure 16:
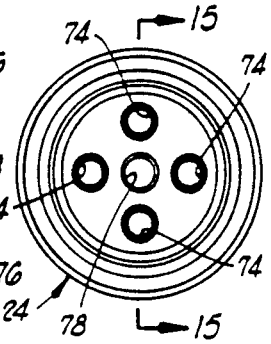
FIG. 16 is an end view of the tandem connector.

The apparatus shown in FIG. 1 can include other equipment, such as a casing collar locator connected above the perforating gun 12. Also, multiple guns 12 can be connected in series, such as by a tandem coupling device 24. A preferred embodiment is shown in FIGS. 15 and 16 and further described hereinbelow.

The components shown assembled in FIG. 1 permit fluid to be circulated through the tubing string 14, the gun 12 and the well as illustrated by arrows 26 in FIG. 1. This circulation flushes sand 28 within the slotted liner 8 so that the perforating gun 12 can be emplaced and removed.

The preferred embodiment of the perforating gun 12 will be described with reference to FIGS. 4–12.

Figure 4:
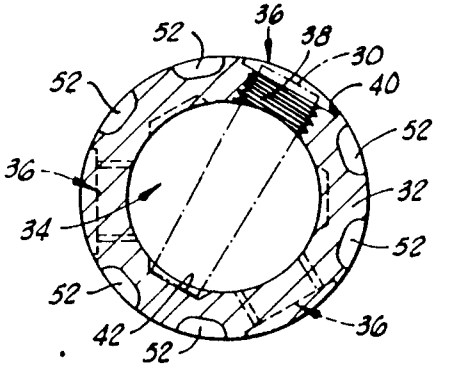
FIG. 4 is an end sectional view, taken along line 4—4 shown in the layout of FIG. 6A but in cylindrical shape, of a support body of the perforating gun of the preferred embodiment of the present invention.

Broadly, the perforating gun 12 includes support means for carrying a plurality of conventional explosive charges, one of which is represented in dot-dash lining and marked with reference numeral 30 in FIG. 4. The perforating gun 12 also includes channel means for conducting a fluid through the support means, which channel means is spaced from where the plurality of explosive charges are carried.

Figure 5:
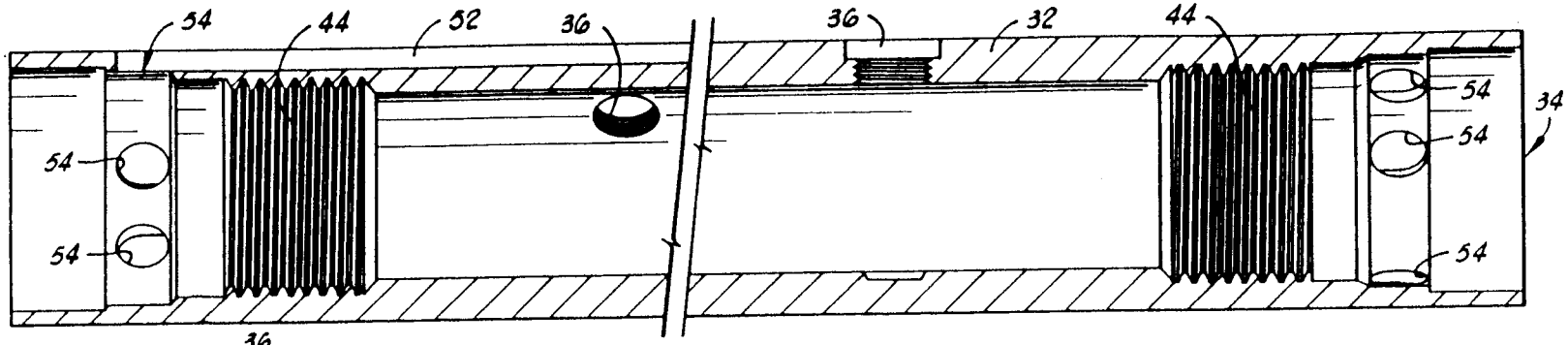
FIG. 5 is a sectional elevational view of portions of the support body taken along lines 5—5 shown in FIGS. 6A and 6B but in cylindrical shape.

Referring to FIGS. 4-6, the support means includes a cylindrical body 32 having an axial opening 34 which makes the body have an annular transverse cross section.

Figure 6A:
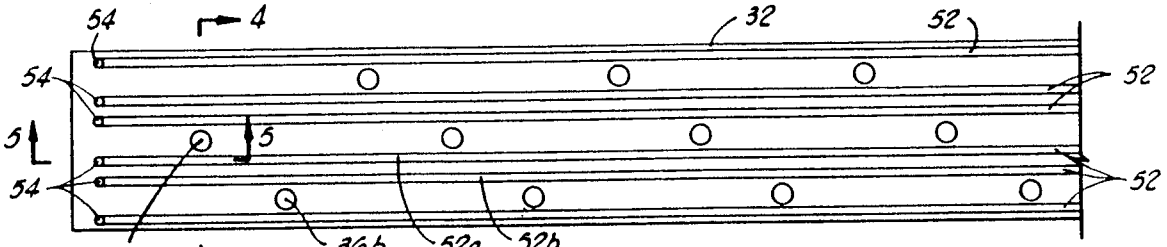
FIGS. 6A and 6B show a flattened, layout view of the support body as if it were unrolled from its preferred cylindrical shape.
Figure 6B:
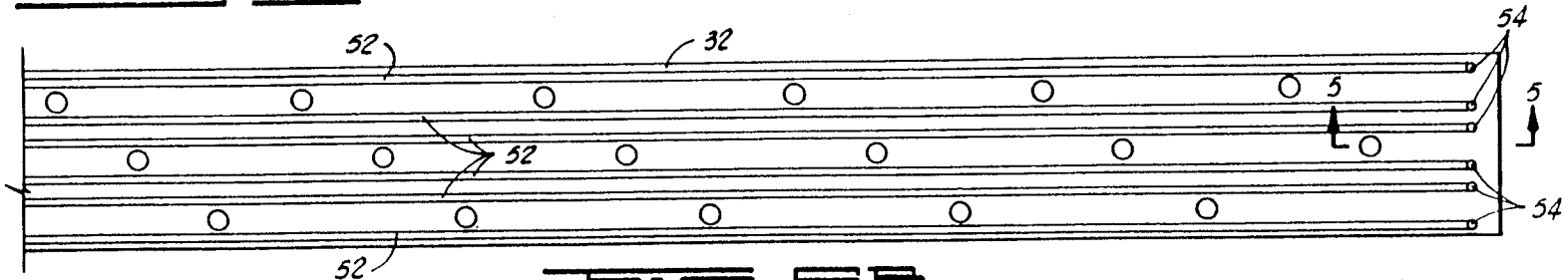

Extending from the axial opening 34 are a plurality of circumferentially and longitudinally spaced radial ports 36 defined through the wall of the body 32. As shown in FIGS. 6A and 6B, there are twenty-eight ports 36 in the illustrated embodiment. The ports 36 can have any desired layout, but a right hand spiral is illustrated in FIGS. 6A and 6B. Other configurations can be used; however, it is preferred that the ports 36 do not circumferentially overlap along the length of the body 32 so that continuous linear longitudinal paths are provided for the channel means. Each of the ports 36 includes a threaded bore 38 axially aligned with a counterbore 40. Spaced across the diameter of the body 32 is an associated recess 42 for supporting the rear end of a charge.

The ends of the support body 32 have threaded portions 44 to receive closure plugs, such as the top sub 18, the bull plug and washing shoe assembly 20 or the tandem 24.

In a specific implementation, the cylindrical body 32 is made of standard 3⅛ inch outer diameter perforating gun material known in the art.

Figure 8:
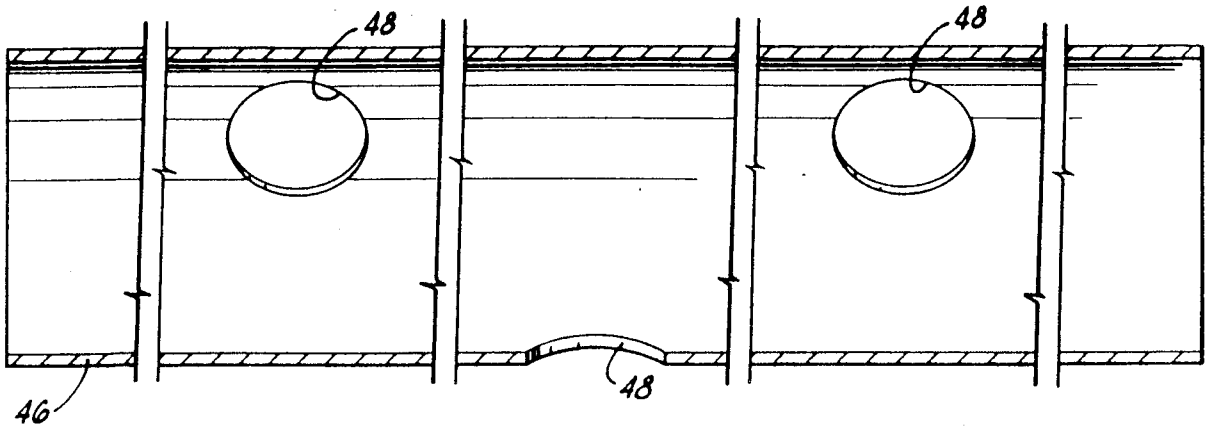
FIG. 8 is a sectional elevational view of portions of the sleeve taken along lines 8-8 shown in FIGS. 9A and 9B but in cylindrical shape.
Figure 7:
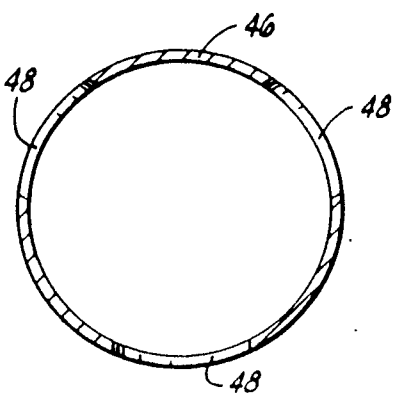
FIG. 7 is an end sectional view, taken along line 7—7 shown in FIG. 9A but in cylindrical shape, of a sleeve of the perforating gun of the preferred embodiment of the present invention.
Figure 9A:
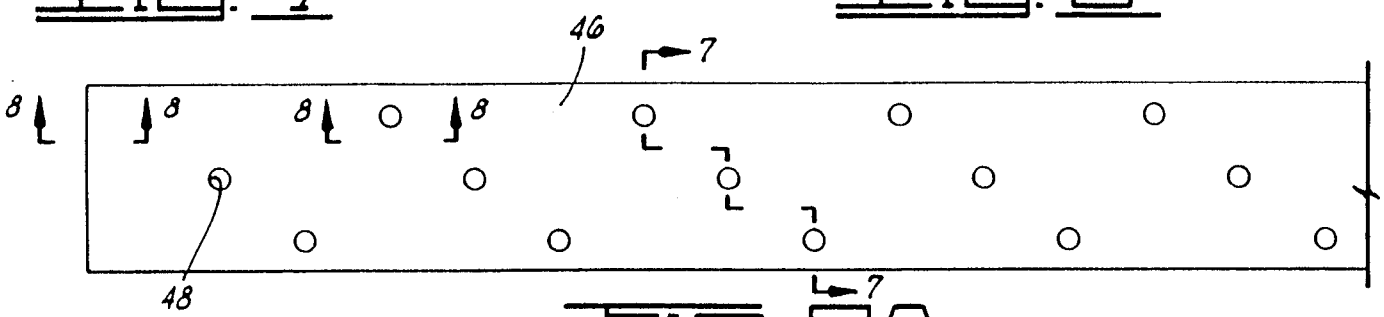
FIGS. 9A and 9B show a flattened, layout view of the sleeve as if it were unrolled from its preferred cylindrical shape.
Figure 9B:
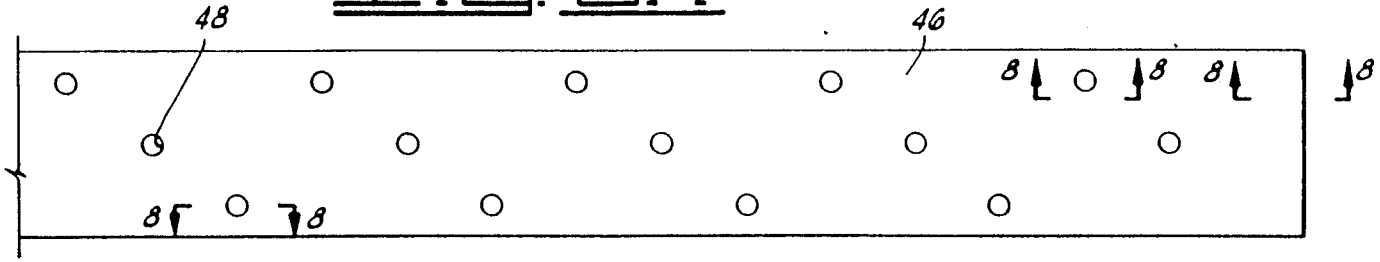
Figure 11:
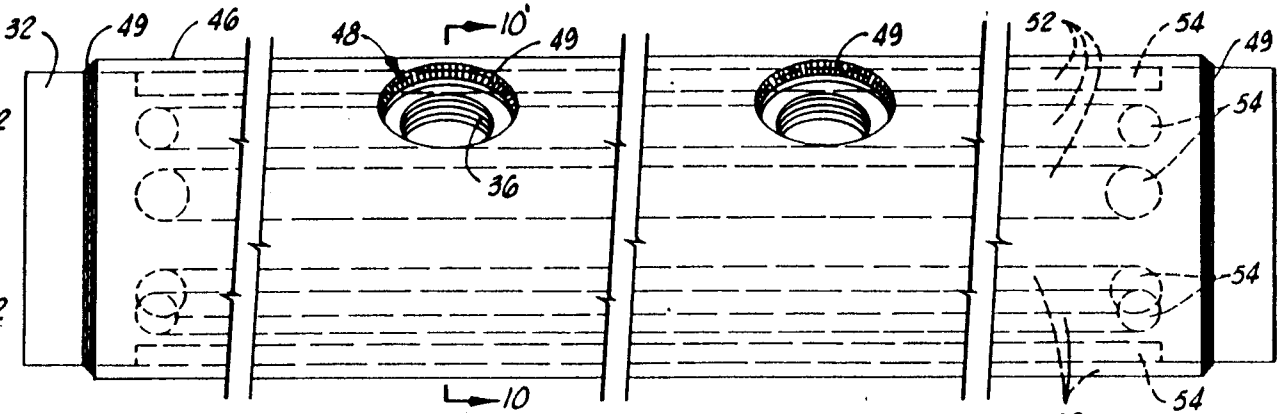
FIG. 11 is an elevational view of portions of the combined support body and sleeve.
Figure 10:
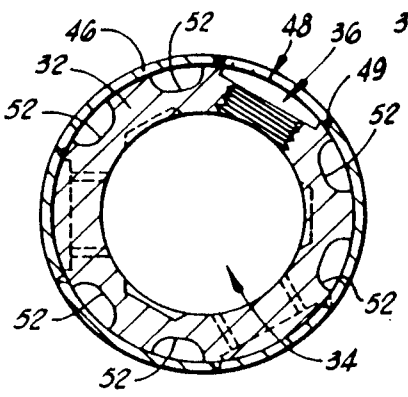
FIG. 10 is an end sectional view, taken along line 10—10 shown in FIG. 11, of the combined support body and sleeve of the perforating gun of the preferred embodiment of the present invention.
Figure 12A:
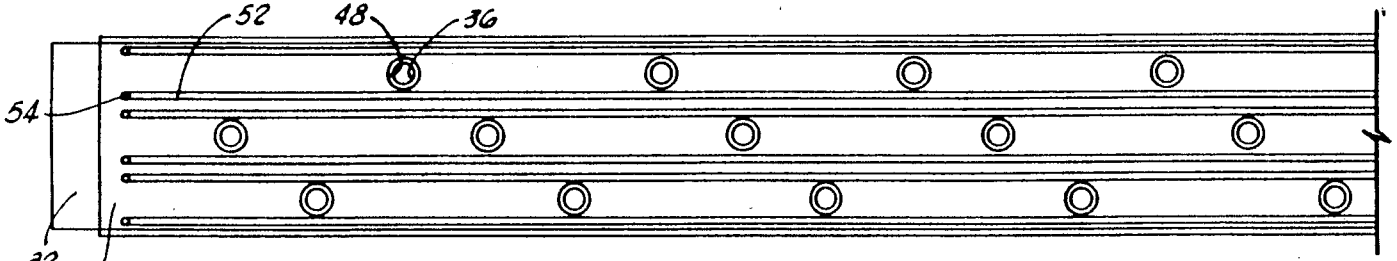
FIGS. 12A and 12B show a flattened, layout view of the combined support body and sleeve (shown as if transparent) as if they were unrolled from their preferred cylindrical shapes.
Figure 12B:
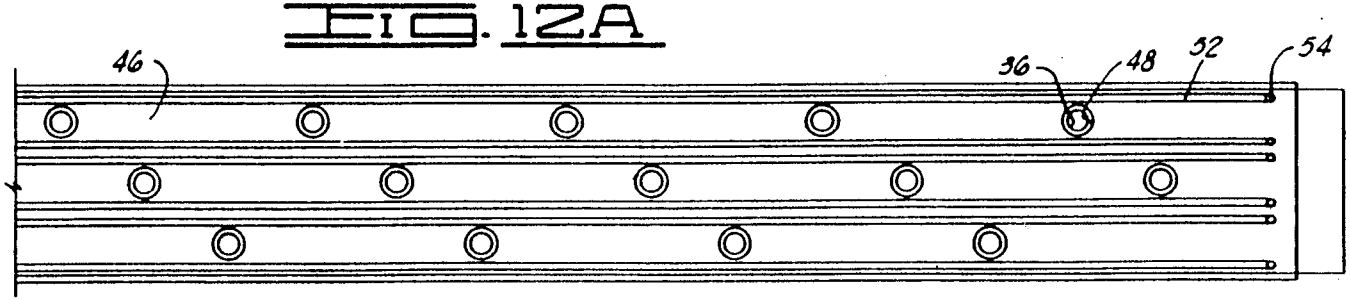

Referring to FIGS. 7–9, the support means of the perforating gun 12 further includes a cylindrical sleeve 46 having a plurality of ports 48 defined therein. The ports 48 are laid out across the sleeve 46 in the same configuration that the ports 36 are laid out across the body 32 as is apparent from a comparison of the layout views shown in FIGS. 6 and 9. Respective ports 36, 48 are aligned when the body 32 is received within the sleeve 46 as shown in FIGS. 10–12. Seals are defined around the ends of the sleeve 46 and around the ports 48. In the preferred embodiment, the seals are defined by weld beads 49 created by welding these portions of the sleeve 46 to the body 32.

In a specific implementation, the sleeve 46 is a ⅛ inch thick sleeve having a 3⅜ inch outer diameter.

Referring to FIGS. 4–6 and 10–12, the channel means is shown to include a plurality of longitudinal grooves 52. The grooves 52 are defined, such as by machining, in the body 32 in between the ports 36. In the preferred embodiment, there are two such grooves between each set of circumferentially adjacent ports 36 of the body 32. For example, there are two grooves 52*a*, 52*b* between circumferentially adjacent ports 36*a*, 36*b*. The grooves 52 are defined in the outer surface of the body 32 so that they face the inner surface of the sleeve 46 which covers the otherwise open channels defined by the grooves 52. The grooves 52 are spaced from the ports 36 so that fluid flowing through the channels bypasses the ports 36 and the charges carried in the ports.

Referring to FIGS. 5, 11 and 12, there are radial openings 54 from the axial opening 34 of the body 32 to communicate fluid between the axial opening 34 and the grooves 52. Only the end portions of the axial opening 34 are in such communication when the perforating gun 12 is used because plugs received in the threaded end portions 44 block fluid flow into the remainder of the axial opening 34 where the explosive charges are.

Figure 13:
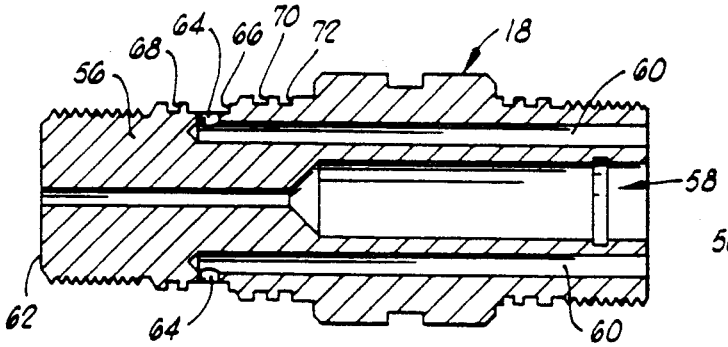
FIG. 13 is a sectional elevational view, taken along line 13—13 in FIG. 14, of a top sub connector.
Figure 14:
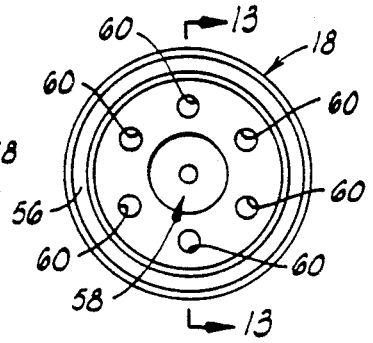
FIG. 14 is an end view of the top sub connector.

Referring to FIGS. 13 and 14, the preferred embodiment of the top sub 18 is shown. The top sub 18 includes a body 56 through which an axial aperture 58 is defined. Six longitudinal cavities 60 are equiangularly spaced around the aperture 58. The cavities 60 terminate short of an end 62 of the body 56, and the cavities 60 open radially through holes 64 into a circumferential groove 66 which communicates with the radial openings 54 in the support body 32 when the end 62 threadedly connects with the respective threaded end 44 of the support body 32 of the perforating gun 12.

The other end of the top sub body 56 connects to the firing head 16. The firing head 16 provides an electrical detonation signal over a conductor (not shown) which passes through the aperture 58 to the charges in the support body 32. A seal (not shown) is formed around the conductor to prevent fluid leakage into the aperture 58 when fluid is pumped down the tubing string 14 through the firing head 16 into the cavities 60. The fluid flows through the cavities 60, out the holes 64, and into the openings 54 and through the grooves 52 of the perforating gun 12. The body 56 of the top sub 18 also includes circumferential grooves 68, 70, 72 for carrying 0-rings (not shown) to form seals with the support body 32 when the top sub 18 is connected into an end of the perforating gun 12 as described.

Referring to FIGS. 15 and 16, the preferred embodiment of the tandem coupling device 24 is shown. The tandem 24 is used for connecting two perforating guns 12 in series. The tandem 24 is constructed similarly to the top sub 18 except there are only four cavities 74 to transfer fluid from the end of one perforating gun 12 to the adjoined end of another perforating gun 12. Additionally, although FIGS. 15 and 16 show the cavities 74 open at one end, this is just a condition during manufacturing because before the tandem 24 is finished, the longitudinal open ends 76 are closed, such as by welding plugs into the open ends, to prevent fluid communication with the interior region of the axial opening 34 of the respective gun 12 where the explosive charges are carried. An axial aperture 78 provides a passthrough for a detonation conductor to the next gun. Other features of the tandem 24 corresponding to the top sub 18 are indicated by the use of like reference numerals.

Figure 17:
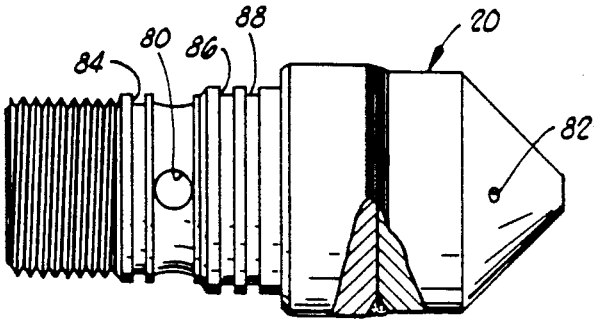
FIG. 17 is an elevational view of a bottom bull plug and washing shoe assembly.

The preferred embodiment of the bull plug and washing shoe assembly 20 is shown in FIG. 17. The assembly 20 screws into the end of the perforating gun 12 opposite the end of the gun connected to the top sub 18 or the tandem 24. The assembly 20 receives fluid into openings 80 (only one shown) from the radial openings 54 at the respective end of the perforating gun 12. This fluid jets out of jet ports 82 (only one shown) to flush sand. Seals (not shown) are carried in grooves 84, 86, 88.

The perforating gun 12 is used in the preferred embodiment methods of the present invention. These methods are used to perforate a well when sand in the well initially blocks or impedes emplacement of the perforating gun 12 at the desired location of perforation or when sand obstructs the retrieval of the perforating gun 12 after the gun is detonated to perforate. For simplicity of explanation, a method pertaining to both obstructed emplacement and obstructed retrieval will be described; however, it is to be understood that a method pertaining only to emplacement and a method pertaining only to retrieval are encompassed by the present invention.

In accordance with the present invention, the perforating gun 12 is lowered into the well. As illustrated in FIG. 1, for the preferred embodiment lowering includes conveying a perforating gun 12 on the tubing string 14. In the preferred embodiment, lowering is made via a coil tubing, such as a 1½ inch coil tubing having a firing line inside for conveying the detonation signal to the firing head 16 as known in the art.

The present invention also includes flowing fluid through the perforating gun 12 before the perforating gun 12 is detonated. For the FIG. 1 illustration, this includes flushing sand 28 within the slotted liner 8 so that a space is made to receive the perforating gun 12 within the slotted liner 8. In a specific implementation, this is achieved by conventionally pumping a foam into the tubing string 14 while lowering the perforating gun 12 on the tubing string 14 into the well. The flow of the foam, or other suitable fluid, which occurs in the preferred embodiment implementation of the present invention is along the flow path illustrated by the arrows 26 in FIG. 1. More particularly, this flow is through the tubing string 14, the firing head 16, the top sub 18, the grooves 52 of the perforating gun 12, the bull plug and washing shoe assembly 20 and back up through the liner 8 and casing 6.

Once the perforating gun 12 has been emplaced, it is detonated in a known manner, such as by sending an electrical signal down the firing line inside the coil tubing of the particular implementation of the tubing string 14. Other types of actuation, such as one using a pressure type initiating system, can be used.

The combined method described herein further comprises flowing fluid through the detonated perforating gun and lifting the detonated perforating gun out of the well. Flowing fluid through the perforating gun 12 after it has been detonated occurs in the preferred embodiment in the same manner as the pre-detonation fluid flow. Such fluid flow again flushes sand which is within the slotted liner 8. This sand can be deposited around the perforating gun in response to detonating the perforating gun 12. It could also result from a collapse of the liner and well bore. In any event, the fluid flow occurring through the perforating gun 12 displaces the sand sufficiently to release the perforating gun for retrieval from the well. This fluid flow can again be achieved by pumping a foam into the tubing string 14 while retrieving the perforating gun 12 from the well on the tubing string 14.

Thus, the present invention is well adapted to carry out the objects and attain the ends and advantages mentioned above as well as those inherent therein. While the preferred embodiment of the invention has been described for the purpose of this disclosure, changes in the construction and arrangement of parts and the performance of steps can be made by those skilled in the art, which changes are encompassed within the spirit of this invention as defined by the appended claims.

What is claimed is:

1. A perforating gun comprising:

support means for carrying a plurality of explosive charges, said support means including a cylindrical body having an axial opening therein from which a plurality of circumferentially and longitudinally spaced radial ports are defined through said body and a cylindrical sleeve having a plurality of ports defined therein, said sleeve receiving said body so that said ports of said body and said sleeve are aligned;

channel means for conducting a fluid through said support means, said channel means comprising two parallel longitudinal grooves positioned between each set of circumferentially adjacent ports of said body and seal means between each aligned port in said body and said sleeve and between each of said ends of said body and said sleeve.

2. A method of perforating a well, having a slotted liner disposed therein into which said was collected comprising:

lowering a perforating gun into the well;

flowing fluid through the perforating gun before the perforating gun is detonated, whereby said contained in said slotted liner is flushed therefrom so that a space is created to receive said perforating gun within said slotted liner; and detonating the perforating gun.

3. A method of perforating a well as defined in claim 2, wherein:

lowering the perforating gun into the well includes conveying the perforating gun on a tubing string; and flowing fluid through the perforating gun before the perforating gun is detonated includes pumping a foam into the tubing string while lowering the perforating gun on the tubing string into the well.

4. A method of perforating a well as defined in claim 3, wherein the tubing string includes a coil tubing.

5. A method of perforating a well as defined in claim 4, wherein flowing fluid through the perforating gun before the perforating gun is detonated further includes flushing with the foam sand within a slotted liner disposed in the well so that a space is made to receive the perforating gun within the slotted liner.

6. A method of perforating a well as defined in claim 5, further comprising:

flowing fluid through the coil tubing and detonated perforating gun to flush said within the slotted liner after the perforating gun is detonated; and lifting the detonated perforating gun out of the well.

7. A method of perforating a well, comprising:

lowering a perforating gun into the well;

detonating the perforating gun; and flowing fluid through the perforating gun after the perforating gun is detonated whereby at least a portion of any sand deposited around the detonating gun in the well in response to detonation of the perforating gun is flushed from around the perforating gun and the gun is thereby released for retrieval from the well.

8. A method of perforating a well as defined in claim 7, wherein:

lowering the perforating gun into the well includes conveying the perforating gun on a tubing string; and flowing fluid through the perforating gun after the perforating gun is detonated includes pumping a foam into the tubing string while retrieving the perforating gun from the well on the tubing string.

* * * * *